US005144806A

United States Patent [19]

Frenzel et al.

[11] Patent Number: 5,144,806

[45] Date of Patent: Sep. 8, 1992

[54] PROCESS FOR THE LIQUEFACTION OF GASES

[75] Inventors: Jochen Frenzel, München; Josef Weber, München; Horst Gutowski, deceased, late of München, all of Fed. Rep. of Germany, by Lieselohe Gutowski, legal representative

[73] Assignee: Linde Aktiengesellschaft, Wiesbaden, Fed. Rep. of Germany

[21] Appl. No.: 707,873

[22] Filed: May 31, 1991

[30] Foreign Application Priority Data

May 31, 1990 [DE] Fed. Rep. of Germany ..... 4017611

[51] Int. Cl.[5] ..... F25J 1/00; F25J 5/00

[52] U.S. Cl. ..... 62/9; 62/12; 62/18; 62/40

[58] Field of Search ..... 55/23; 62/9, 12, 18, 62/40

[56] References Cited

U.S. PATENT DOCUMENTS

| | | | |
|---|---|---|---|
| 3,398,506 | 8/1968 | Baldus | 55/23 |
| 3,418,820 | 12/1968 | Swearingen | 62/12 |
| 3,691,779 | 9/1972 | Meisler | 62/39 X |
| 3,792,591 | 2/1974 | Collins | 62/22 X |
| 3,815,376 | 6/1974 | Lofredo et al. | 62/22 |
| 3,854,913 | 12/1974 | Leyarovski et al. | 62/12 |
| 3,854,914 | 12/1974 | Leyarovski et al. | 62/12 |
| 4,192,661 | 3/1980 | Johnson | 62/12 |
| 4,698,073 | 10/1987 | Rohde et al. | 62/18 X |

OTHER PUBLICATIONS

"A Hydrogen Liquefier with Helium Refrigeration Cycle", Kurihara et al., Proceedings of 7th Intl. Cryogenic Engineering Conf., Jul. 1978.

*Primary Examiner*—Henry A. Bennet
*Assistant Examiner*—Christopher Kilner
*Attorney, Agent, or Firm*—Millen, White & Zelano

[57] ABSTRACT

Gases, e.g., helium, are treated to freeze out impurities in the form of liquid and solids, and resultant gases are liquefied in a refrigerating unit. For automatic control of the freeze purification system, control of this process is responsive to two performance figures, namely, the liquefaction performance of refrigerating unit and the degree of impurities in the available crude gas. The purification process comprises an alternating sequence of purification phases A and regeneration phases B. The amount of gas used in regeneration phase B for liquefaction is additionally produced in purification phase A and intermediately stored in a medium-pressure buffer vessel. The sequence of purification phases A and regeneration phases B is continued up to a pressure $P_{Mmax}$ in the buffer vessel. Once this pressure is reached, the freeze purification system is regenerated; then, in an idle phase C, the pressure in the buffer vessel is reduced to $P_{Mmin}$ by liquefaction of the gas. Then the sequence of purification phases A and regeneration phases B starts again.

10 Claims, 2 Drawing Sheets

PROCESS FOR THE LIQUEFACTION OF GASES

BACKGROUND OF THE INVENTION

This invention relates to a process for the liquefaction of gases, for example, helium, and especially to a process wherein impurities are frozen out, first in a freeze purification system, and removed from the gas; then the purified gas is liquefied in a refrigerating unit. The freeze purification system, in an alternating sequence of purification phases and regeneration phases, is alternately brought into thermal contact with cold gas and hot gas from the refrigerating unit and in each purification phase a part of the purified gas is stored in a medium-pressure buffer vessel at a pressure of $P_M$, while in each regeneration phase, a part of the gas stored in the medium-pressure buffer vessel is liquefied.

Gases, which are to be liquefied in a refrigerating unit, for example in a helium cryostat, must be freed beforehand of impurities, which could otherwise lead to "icing" of the equipment parts of the refrigerating unit. It is known, for example, from DKV-Tagungsbericht [German Refrigerating Society, Proceedings], vol. 8 (1981), pages 101–118, to remove air impurities from crude helium by condensing and freezing, before the purified helium is liquefied in a refrigerating unit. For the purification of the crude helium, there is employed a freeze purification system comprised of heat exchangers and a separator.

In the heat exchangers, the crude helium is brought into indirect thermal contact with cold gas from the refrigerating unit so that the air impurities are condensed as liquids and then residual air impurities are frozen out as solids from the crude helium. Condensed liquid air is carried off from the separator to the atmosphere. Since the heat exchangers become iced in time by frozen-out air components, the freeze purification system has to be regularly regenerated. For this purpose, warm gas from the refrigerating unit is conducted countercurrently through the freeze purification system. Since during the regeneration phase, an amount of pure helium must be liquefied for the process to run continuously, this extra amount has to be produced and stored during the purification phase. This intermediate storage takes place in a medium-pressure buffer vessel at a pressure $P_M$.

SUMMARY OF THE INVENTION

An object of this invention is to provide an improved process of the above-mentioned type and preferably a process which is continuous and substantially trouble-free, and wherein fully automatic operation of the freeze purification system is substantially ensured.

Upon further study of the specification and appended claims, further objects and advantages of this invention will become apparent to those skilled in the art.

These objects according to the invention are achieved in that in the medium-pressure buffer vessel a pressure rise rate $P_M$ is preset for each purification phase, the sequence of purification phases and regeneration phases continues up to a maximum pressure $P_{Mmax}$, the freeze purification system is again regenerated, then the pressure in the medium-pressure buffer is reduced to a minimum pressure $P_{Mmin}$ by liquefaction of the gas, and then the sequence of purification phases and regeneration phases is started again.

Preferably, the rate of pressure rise $P_M$ is controlled as a function of the liquefaction performance of the refrigerating unit, i.e., the amount of gas liquefied by the plant into the liquid helium tank in, e.g., liters per hour. Different $P_M$ values are preset for basically different liquefaction performances, as different modes of operation of the refrigerating unit require them (e.g., with or without liquid nitrogen precooling).

Variations in the degree of impurities of the crude gas are advantageously controlled by controlling the cold gas feed from the refrigerating unit to the freeze purification system.

The temperature in the freeze purification system is suitably kept constant during each purification phase by regulation of the amount of crude gas as well as of the cold gas conducted from the refrigerating unit to the freeze purification system.

The process according to the invention can be used in the liquefaction of gases of all types, in which impurities of the crude gas have to be removed before the liquefaction. The process is especially suitable for liquefaction of helium and hydrogen.

Since a continuous, trouble-free and fully automatic operation of the freeze purification system is substantially achieved with the process according to the invention, the servicing of the entire gas liquefaction system is facilitated, and the direct labor costs for operating the liquefaction unit are reduced.

BRIEF DESCRIPTION OF THE DRAWINGS

The invention is explained below in greater detail by an embodiment diagrammatically illustrated in the figures, wherein.

DETAILED DESCRIPTION OF THE DRAWINGS

In this embodiment helium is to be liquefied. The available crude helium contains about 5% by volume of air as an impurity.

Figure 1:
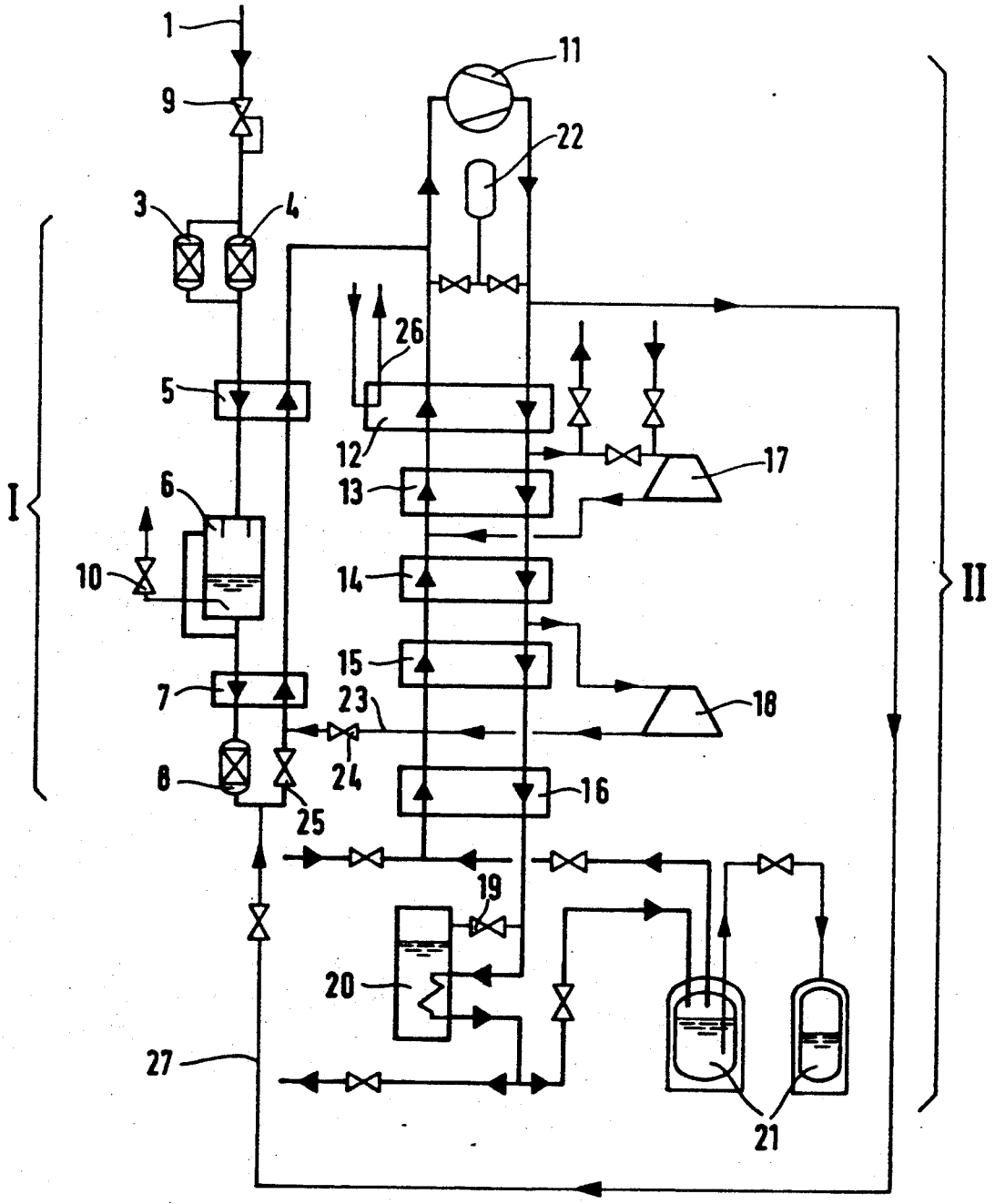
FIG. 1 is a flow chart of a preferred embodiment of the invention, including a refrigerating unit with an upstream freeze purification system.

According to FIG. 1, the impure crude helium having a temperature of about 300 K. and an upstream pressure of about 25 to about 200 bars is passed into pipe 1, which leads to freeze purification system I comprising two adsorbers 3, 4, a condensation heat exchanger 5, a separator 6, a freeze-out heat exchanger 7 and a hydrogen-neon adsorber 8. First, the crude helium is expanded in pressure reducer 9 to the operating pressure of about 20 bars of alternately operating adsorbers 3 and 4, which are used for drying the helium, i.e., removal of $H_2O$. After drying, the helium is cooled to the condensation temperature of the air with a cold gas current branched from refrigerating unit II. The condensed air is discharged from separator 6 into the open air by pipe 10. The residual air portion of about 1% remaining in the helium gas is frozen out in downstream freeze-out heat exchanger 7. Then the resultant helium is passed into a conventional hydrogen-neon adsorber 8.

The purified helium is conducted by heat exchangers 7 and 5 into refrigerating unit II, comprising a circulating compressor 11, five heat exchangers 12 to 16, two expansion turbines 17, 18, a Joule-Thomson expansion valve 19, a gas-liquid phase separator 20, as well as liquid helium tanks 21 and various helium transfer pipes.

The valved conduits at the inlet of the expansion turbine 17 are feed and return lines to supply, e.g., the radiation shield of a superconducting magnet with cold gas (typically 70 K.), thereby reducing radiation heat input to the magnet itself. These lines are optional equipment of the plant in which the described purifier is installed.

The valved conduits at the bottom left of heat exchanger 16 and bottom left of condenser 20 are also feed and return lines (the so-called refrigerator connection), but supply, e.g., the superconducting magnet itself with cold gas or liquid helium (typically below 5 K.).

Medium-pressure buffer vessel 22 operative at 4 to 8 bars for the intermediate storage of the purified helium and pipe 23 for passing cold gas from refrigerating unit II to the freeze purification system I is important for the functioning of the freeze purification system. The operation of the freeze purification system is essentially controlled by two regulating valves. Valve 24 determines the cold feed to heat exchangers 7 and 5, while valve 25 determines the amount of crude helium to be purified.

For a continuous, high efficiency, fully automatic and trouble-free operation of the freeze purification system, the freeze purification system has to be automatically responsive to two performance figures and has to have its operating parameters adjusted to them. These performance figures are:

(a) the liquefaction performance of the refrigerating unit, and (b) the degree of impurities in the available crude gas.

These relationships primarily require a defined development of pressure $P_M$ in medium-pressure buffer vessel 22. This is achieved by the purification of more helium in the purification phase than is used in the regeneration phase and, in turn, is achieved by the setting of a rate of pressure rise $P_M$ on valve 25. Different rates of pressure rise $P_M$ are preset for basically different liquefaction performances, as different modes of operation require them (e.g., with or without liquid nitrogen precooling by pipe 26). Variations in the degree of impurity of the crude helium are responded to and controlled by valve 24 in the cold gas feed 23.

To keep as constant as possible the temperature of about 62 K. at the output of condensation heat exchanger 5 which is important for the course of the process, valve 25, regulating the amount of crude gas, is provided with a regulating window of ±0.7 K. Outside the window, regulating valve 25 supports valve 24, regulating the cold feed (high priority), within the window it is regulated to the described pressure rise (low priority).

The operation of the system is based on an alternating sequence of purification phases and regeneration phases. After completion of the purification phase, the freeze purification system is regenerated with a warm gas current, which is drawn off from the high-pressure side of refrigerating unit II by pipe 27. In this case, the flow is through the parts of freeze purification system I in the direction of freeze-out heat exchanger 7 to condensation heat exchanger 5 and results in one impure helium stream which is withdrawn after 5. While this impure helium stream is discharged to recompression (by a conduit not shown in the drawing), the clean regeneration gas stream is recycled to the suction side of compressor 11.

The liquid air accumulating in separator 6 during the regeneration phase is discharged into the environment. Then all the equipment parts of the freeze purification system are again cooled to the operating temperature by cold gas by opening valve 24.

In the regeneration phase, the above-named relationships are taken into account so that different degrees of icing of freeze-out heat exchanger 7 are compensated for by heating the freeze-out heat exchanger to a defined temperature $T_{min1}$. The cyclic recooling of the freeze purification system to a defined lower temperature $T_{min2}$ is analogously performed. This results in the freeze purification system always having the same temperature condition at the beginning of the purification phase.

Figure 2:
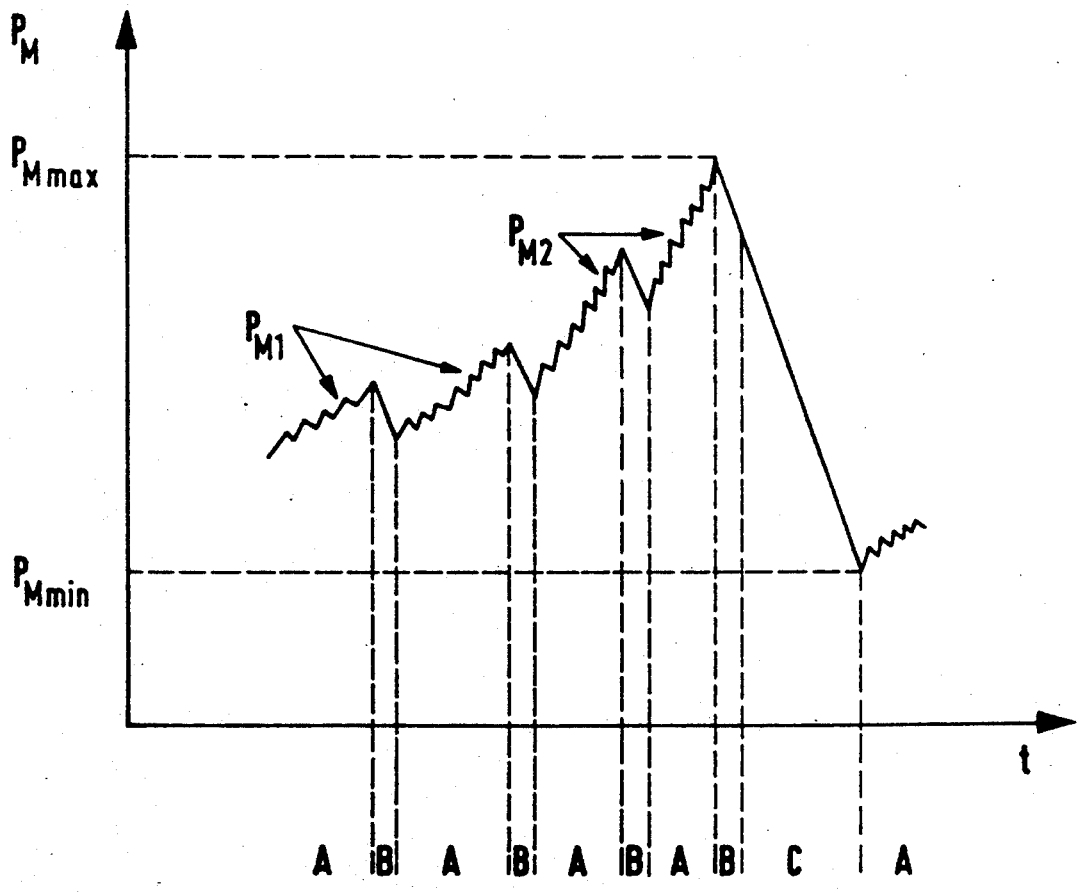
FIG. 2 is a graphic representation of the pressure characteristic $P_M$.

As is seen from FIG. 2, the sequence of purification phases A and regeneration phases B is continued to a pressure $P_{Mmax}$. Once this pressure is reached, the freeze purification system is regenerated as usual; then in an idle phase C the pressure is reduced to $P_{Mmin}$ by liquefaction of the helium. Then the sequence of purification phases A and regeneration phases B begins again.

In the case shown in FIG. 2, different pressure rise rates $P_{M1}$ and $P_{M2}$ are preset as a function of the liquefaction performance of the refrigerating units.

For reasons of energy, it is important to let purification phases A and regeneration phases B follow an idle phase C over as long as possible a period. This requires the exact determination of sufficient but not excessive, pressure rise rates $P_M$.

Without further elaboration, it is believed that one skilled in the art can, using the preceding description, utilize the present invention to its fullest extent. The following preferred specific embodiments are, therefore, to be construed as merely illustrative and not limitative of the remainder of the disclosure in any way whatsoever.

In the foregoing and in the following example, all temperature are set forth uncorrected in degrees Kelvin; and, unless otherwise indicated, all parts and percentages are by weight.

The entire disclosures of all applications, patents, and publications, cited above and below, and of corresponding German application No. P 40 17 611.8, are hereby incorporated by reference.

In the following example, the letters A, B, and C refer to FIG. 2, and the subscript numbers 5, 6, 7, 8, and 23 refer to the apparatus described in FIG. 1.

EXAMPLE

Phase A: Purification

Time interval, 150 minutes:

$p_5$=20 bar, $T_5$=300–62 K.
$p_6$=20 bar, $T_6$=62 K.
$p_7$=20 bar, $T_7$=62–30 K.
$p_8$=20 bar,
$p_{23}$=12 bar, $T_{23}$=11 K.

Phase B: Regeneration

Time interval, about 30 minutes:

Warming up and cooling down to operating temperature.

Having reached this temperature, start of next purifier cycle or Phase C.

Phase C: Stand-by:

After having reached $P_{Mmax}$ and after having completed regeneration Phase B, the purification and regeneration steps are put on stand-by until $P_{Mmin}$ is reached by liquefying gas from the buffer. Then the sequence starts again with the next purification Phase A. In general, it is preferred that all regeneration phases are equal from a time standpoint.

The preceding example can be repeated with similar success by substituting the generic or specific reaction and/or operation conditions of this invention for those used in the preceding examples.

From the foregoing description, one skilled in the art can easily ascertain the essential characteristics of this invention and, without departing from the spirit and scope thereof, can make various changes and modifications of the invention to adapt it various usages and conditions. For example, the above-described method analogously applies to the liquefaction of other gases, such as, e.g., hydrogen.

What is claimed is:

1. In a process for liquefying gases, comprising in a freeze purification system having a temperature, removing impurities from an amount of gas to be purified having a degree of impurities, liquefying resultant purified gas, and bringing the freeze purification system in an alternating sequence of purification phases and regeneration phases alternately into thermal contact with cold gas and hot gas from a refrigerating unit, and in each purification phase storing a part of resultant purified gas in a medium-pressure buffer vessel at a pressure of $P_m$, and in each regeneration phase liquefying a part of the gas stored in the medium-pressure buffer vessel, the improvement wherein in medium-pressure buffer vessel, a rate of pressure rise $P_M$ is preset for each purification phase (A), a sequence of purification phases (A) and regeneration phases (B) is continued up to a maximum pressure $P_{Mmax}$, the freeze purification system is further regenerated, then pressure in the medium-pressure buffer vessel is reduced in phase (C) to a minimum pressure $P_{Mmin}$ by liquefaction of gas stored in the buffer vessel, and the sequence of purification phases (A) and regeneration phases (B) is repeated.

2. A process according to claim 1, wherein the rate of pressure rise $P_M$ is adjusted as a function of liquefaction performance of the refrigerating unit.

3. A process according to claim 1, wherein the amount of cold gas from the refrigerating unit to be brought into thermal contact with the freeze purification system is adjusted as a function of the degree of impurities of the gas to be purified.

4. A process according to claim 2, wherein the amount of cold gas from the refrigerating unit to be brought into thermal contact with the freeze purification system is adjusted as a function of the degree of impurity of the gas to be purified.

5. A process according to claim 1, wherein the temperature in said freeze purification system is kept constant during each purification phase (A) by regulation of the amount of gas to be purified as well as of the cold gas to be brought into thermal contact with the freeze purification system.

6. A process according to claim 2, wherein the temperature in said freeze purification system is kept constant during each purification phase (A) by regulation of the amount of gas to be purified as well as of the cold gas to be brought into thermal contact with the freeze purification system.

7. A process according to claim 3, wherein the temperature in said freeze purification system is kept constant during each purification phase (A) by regulation of the amount of gas to be purified as well as of the cold gas to be brought into thermal contact with the freeze purification system.

8. A process according to claim 4, wherein the temperature in said freeze purification system is kept constant during each purification phase (A) by regulation of the amount of gas to be purified as well as of the cold gas to be brought into thermal contact with the freeze purification system.

9. A process according to claim 1, wherein the gas to be liquefied is helium.

10. A process according to claim 8, wherein the gas to be liquefied is helium.

* * * * *

UNITED STATES PATENT AND TRADEMARK OFFICE

CERTIFICATE OF CORRECTION

PATENT NO. : 5,144,806

DATED : Sept. 8, 1992

INVENTOR(S) : Jochen FRENZEL et al.

It is certified that error appears in the above-identified patent and that said Letters Patent is hereby corrected as shown below:

Title page, item [75], line 4, "Lieselohe"

Should read --Lieselotte--

Signed and Sealed this

Fourteenth Day of September, 1993

*Attest:*

*Attesting Officer*

BRUCE LEHMAN

*Commissioner of Patents and Trademarks*